US009659431B2

(12) United States Patent
Montenegro et al.

(10) Patent No.: US 9,659,431 B2
(45) Date of Patent: May 23, 2017

(54) GAMING MACHINE WITH IMPROVEMENTS TO REPLAY FUNCTIONALITY

(71) Applicant: Atlas Gaming Technologies Pty. Ltd., Port Melbourne (AU)

(72) Inventors: Daniel Julio Montenegro, Port Melbourne (AU); Robert Sloot, Port Melbourne (AU); Alessandro Ciampoli, Port Melbourne (AU); Zenja Solaja, Port Melbourne (AU); Wade Clark, Port Melbourne (AU); Boris Mitelman, Port Melbourne (AU)

(73) Assignee: Atlas Gaming Technologies Pty Ltd. (AU)

( * ) Notice: Subject to any disclaimer, the term of this patent is extended or adjusted under 35 U.S.C. 154(b) by 0 days.

(21) Appl. No.: 14/245,993

(22) Filed: Apr. 4, 2014

(65) Prior Publication Data

US 2015/0018076 A1 Jan. 15, 2015

(30) Foreign Application Priority Data

Apr. 17, 2013 (AU) ..... 2013901348

(51) Int. Cl.
*G07F 17/32* (2006.01)

(52) U.S. Cl.
CPC ..... *G07F 17/3211* (2013.01); *G07F 17/323* (2013.01)

(58) Field of Classification Search
CPC ..... G07F 17/3211; G07F 17/3267
USPC ..... 463/25
See application file for complete search history.

(56) References Cited

U.S. PATENT DOCUMENTS

| | | | | |
|---|---|---|---|---|
| 6,270,411 | B1 * | 8/2001 | Gura et al. | 463/20 |
| 2004/0027500 | A1 * | 2/2004 | Davidson | A61B 1/00045 348/809 |
| 2004/0102235 | A1 * | 5/2004 | Berman | 463/16 |
| 2010/0210351 | A1 * | 8/2010 | Berman | G07F 17/3246 463/25 |
| 2012/0004033 | A1 * | 1/2012 | Lyons | G06F 3/04886 463/35 |
| 2012/0096397 | A1 * | 4/2012 | Ording et al. | 715/802 |

* cited by examiner

*Primary Examiner* — Omkar Deodhar
*Assistant Examiner* — Shauna-Kay Hall
(74) *Attorney, Agent, or Firm* — Lerner, David, Littenberg, Krumholz & Mentlik, LLP

(57) ABSTRACT

A gaming machine has a display device; an input device; and a controller comprising a processor and a memory device. The memory device stores a plurality of instructions which when executed by the processor cause the processor to operate with the display device and the input device to display game data in the gaming window on the display device for each of a plurality of plays of a game. The gaming window has sides defining a geometrical shape and defining an enclosed area for presenting the game data on the display device. Upon a replay triggering event, the processor resizes the geometric shape of the gaming window and replays at least one of a plurality of plays of the game in the resized gaming window, wherein the game data displayed in the resized gaming window is accordingly scaled.

14 Claims, 7 Drawing Sheets

GAMING MACHINE WITH IMPROVEMENTS TO REPLAY FUNCTIONALITY

CROSS-REFERENCE TO RELATED APPLICATIONS

The present application claims priority from Australian Provisional Patent Application No 2013901348 filed on 17 Apr. 2013, the content of which is incorporated herein by reference.

TECHNICAL FIELD

Described embodiments generally relate to a gaming machine having improvements to replay functionality.

BACKGROUND

Gaming machines have jurisdictionally controlled standards with core requirements. One core requirement common to most slot machines is to replay or recall previously played games in an audit mode screen. In such a mode it is possible to view gaming machine meters at a particular point in time, view previously or last played games, and view game statistics, whilst also enabling a player to perform non-player related functions.

The last game play information held by a gaming machine shows the player the results of the play or plays as the player originally saw it. The manner in which the information is provided enables the observer to clearly identify the game sequences and the result or results that occurred.

Known methods of effecting replay or recall of a previously played game is to use keyboard buttons, also known as player key buttons, to select the desired game to display on the gaming machine's display device. The recalled game is then replayed as a full screen game. However a problem with this method is that it can confuse the operator and/or player as to whether the game displayed is a recall game or whether the game displayed is a fresh game, i.e one in which the player is paying for.

Any discussion of documents, acts, materials, devices, articles or the like which has been included in the present specification is not to be taken as an admission that any or all of these matters form part of the prior art base or were common general knowledge in the field relevant to the present disclosure as it existed before the priority date of each claim of this application.

Throughout this specification the word "comprise", or variations such as "comprises" or "comprising", will be understood to imply the inclusion of a stated element, integer or step, or group of elements, integers or steps, but not the exclusion of any other element, integer or step, or group of elements, integers or steps.

SUMMARY

A gaming machine is provided comprising:

a display device;

an input device;

a controller comprising a processor and a memory device, the memory device storing a plurality of instructions which when executed by the processor cause the processor to operate with the display device and the input device to:

(i) for each of a plurality of plays of a game, display game data in the gaming window on the display device, the gaming window having sides defining a geometrical shape and defining an enclosed area for presenting said game data on the display device; and (ii) upon a replay triggering event, resize the geometric shape of the gaming window and replay at least one of said plurality of plays of the game in the resized gaming window, wherein the game data displayed in the resized gaming window is accordingly scaled.

The resized geometric shape of the gaming window may subsequently be referred in this specification as the gaming window in a 'replay format'.

The at least one replayed play of the game may comprise the last played game. In embodiments where a plurality of plays of a game are replayed the replayed games may be replayed by a player/operator in no particular order. In an optional embodiment the number of replayed plays of the game may be determined based on at least one of the wagers placed by a player.

Preferably resizing the geometric shape of the gaming window comprises shrinking respective sides of the gaming window. Each side of the gaming window may be proportionally shrunk. The gaming window can be resized and positioned anywhere on an audit mode screen on the display device.

The processor may further operate with the display device and the input device to display a border associated with at least one side of the gaming window when the gaming window is in a replay format. The border may comprise functionality to enable a player/operator to do any one of more of play, pause, fast forward and rewind through one or more plays of a game.

The processor may further operate with the display device and the input device to control processes for defining the size and shape of a replay control window. The replay control window may be configured to provide a player/operator access to one or more of each of the plurality of plays of a game, machine information, accounting information and game play statistics.

The replay control window may be displayed adjacent the gaming window when the gaming window is in a replay format.

The display device may be a touch screen display.

The replay triggering event is preferably activated via the input device. The input device may be a soft key.

The replay triggering event may comprise a thumbnail image. The memory device may cause the processor to further operate with the display device and the input device to present on the display device a plurality of thumbnail images. The plurality of thumbnail images may be displayed within a window frame area on the display device.

It should be appreciated that thumbnail images are smaller copies of the original replayed games. Each thumbnail image may be of a game selection button or an image of the start of a previously played game. One of the plurality of thumbnail images which are displayed within a window frame area on the display device may be oversized relative to the remaining thumbnail images; wherein the oversized image highlights the active replayed game from the list.

The controller may be configured such that swiping of the thumbnail images rotates the respective games played from left to right of the screen and from right to left of the screen to show other replayed games. Selection of the oversized thumbnail causes the controller to replay the entire game.

The gaming machine may further comprise an audio module and audio output device such that when the window frame area is swiped and/or the oversized thumbnail picture is selected the controller, via the audio module generates a sound for output at the audio output device.

This summary is provided to introduce a selection of concepts that are further described below in the detailed description. This summary is not intended to identify key or essential features of the claimed subject matter, nor is it intended to be used as an aid in limiting the scope of the claimed subject matter.

BRIEF DESCRIPTION OF DRAWINGS

In order that the present invention may be more clearly ascertained, embodiments will now be described, by way of example, with reference to the accompanying drawing, in which.

DESCRIPTION OF EMBODIMENTS

Figure 1:
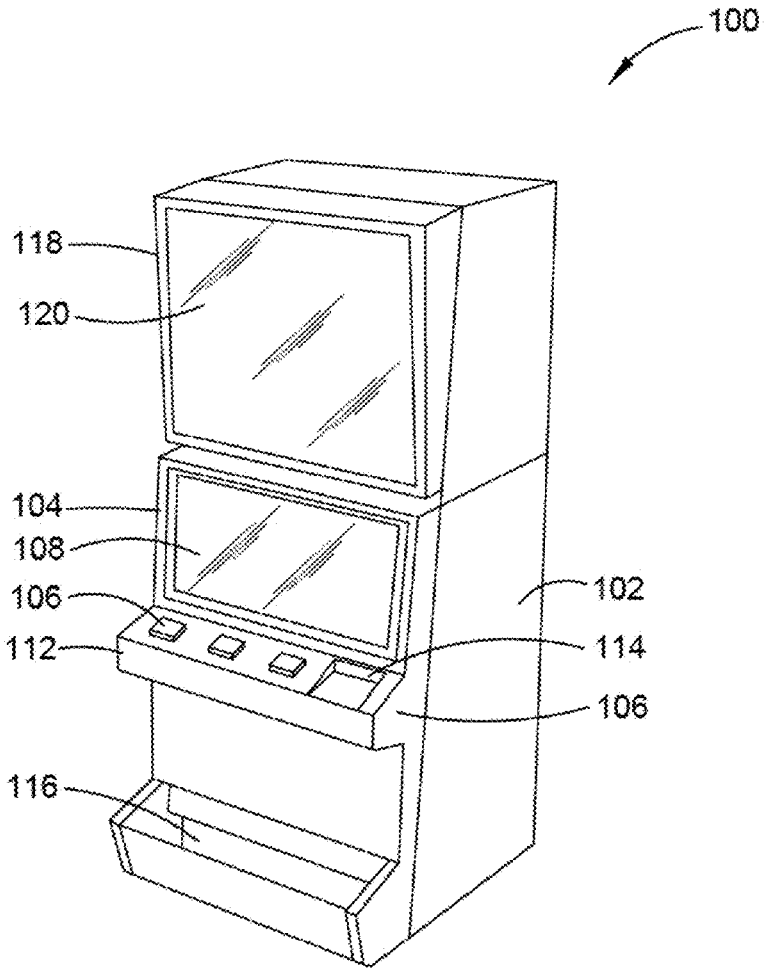
FIG. 1 shows a perspective view of a gaming machine.

Described embodiments generally relate to a gaming machine having improvements to replay functionality.

The gaming system can take a number of different forms. In a first form, a stand-alone gaming machine is provided wherein all or most components required for implementing the game are present in a player operable gaming machine.

In a second form, a distributed architecture is provided wherein some of the components required for implementing the game are present in a player operable gaming machine and some of the components required for implementing the game are located remotely relative to the gaming machine. For example, a "thick client" architecture may be used wherein part of the game is executed on a player operable gaming machine and part of the game is executed remotely, such as by a gaming server; or a "thin client" architecture may be used wherein most of the game is executed remotely such as by a gaming server and a player operable gaming machine is used only to display audible and/or visible gaming information to the player and receive gaming inputs from the player.

However, it will be understood that other arrangements are envisaged. For example, an architecture may be provided wherein a gaming machine is networked to a gaming server and the respective functions of the gaming machine and the gaming server are selectively modifiable. For example, the gaming system may operate in standalone gaming machine mode, "thick client" mode or "thin client" mode depending on the game being played, operating conditions, and so on. Other variations will be apparent to persons skilled in the art.

One or more of the method steps described in this disclosure may be implemented by executable instructions and parameters 232, 234 (See FIG. 2), stored in the memory 204, 206, 230 (See FIG. 2), that may form software embodiments of the system 100. These instructions 232, 234 that form the system 100 may be executed by the CPU 202 (See FIG. 2) or any other processor. Further, the processor 202, the memory 204, 206, 230, the instructions 232, 234 stored therein, or a combination thereof may serve as a means for performing one or more of the method steps described herein.

Figure 2:
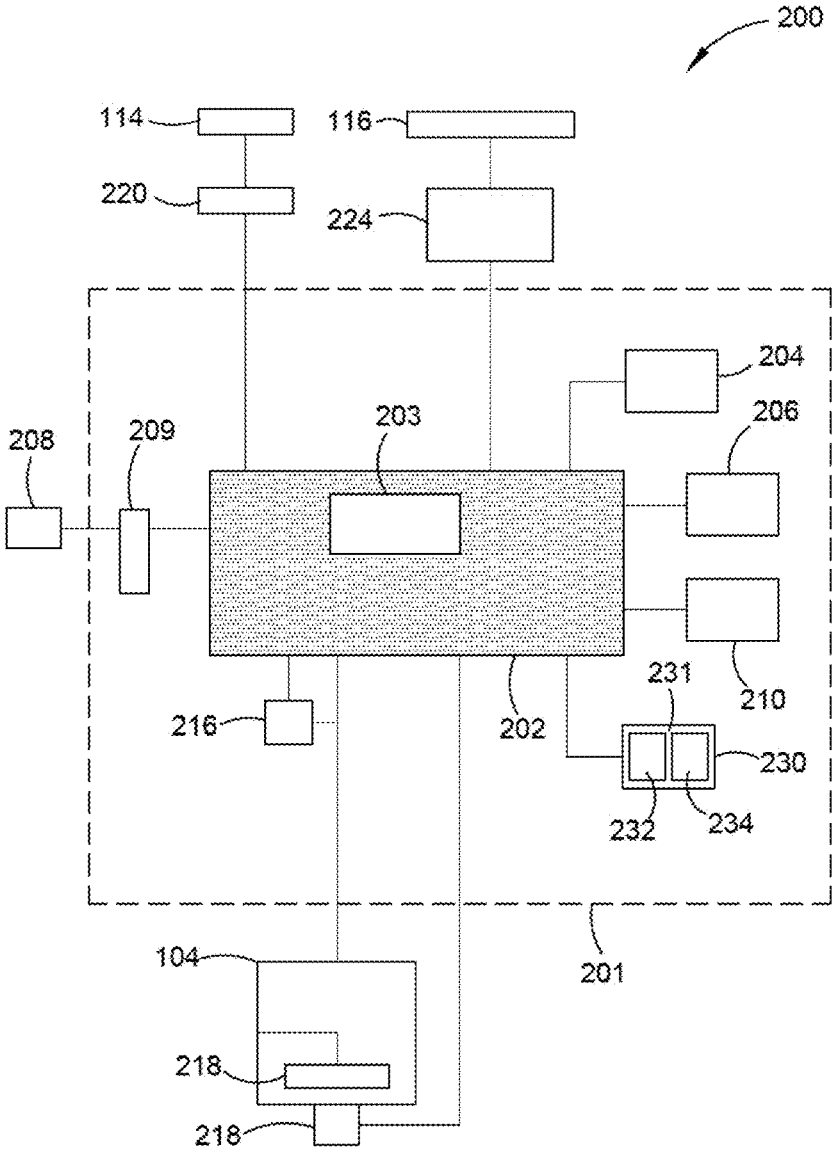
FIG. 2 shows a block diagram of a game logic circuitry of the gaming machine illustrated in FIG. 1.

Irrespective of the form, the gaming system 100 has several core components. At the broadest level, the core components are a player interface in the form of a touch screen 108 as illustrated in FIG. 1 and a game controller 200 as illustrated in FIG. 2. The player interface is arranged to enable manual interaction between a player and the gaming system and for this purpose includes the input/output components required for the player to enter instructions and play the game.

Referring now to FIG. 1, reference numeral 100 generally designates a stand-alone gaming system including a game. Hereinafter, the stand-alone gaming system 100 will be referred to as a gaming machine.

The gaming machine 100 includes a console 102 which contains all or most components required to implement a game play whereby a player wins or loses a wager. Access to the components is by way of a hinged door 105. Moulded to the exterior of the console 102 is a display means in the form of at least one visual display unit 104 on which one or more games is played. The video display unit 104 may be implemented as a liquid crystal display, a plasma screen, as a cathode ray screen device or the like. Whilst the console 102 illustrated in FIG. 1 shows a single visual display unit 104, there can be more than one visual display unit on a typical machine. What is displayed on the visual display unit 104 will depend on what the intended goal of the unit is in relation to the player and any other potential participants in the gaming system.

The gaming machine includes a tactile input for a player to interact via touch with the gaming machine 100. In this example, the tactile input is in the form of a combination of pushbuttons 106 and a touch screen 108 for enabling a player to play one or more games. The touch screen is an electronic visual display that can detect the presence and location of a touch within the display area. The touch screen 108 is used during the game play between start of a game and the end of a game. A game is considered to have started once a wager is placed and considered complete once the wager has been lost or won. Certain functions of the pushbutton are: initiation of game play, credit output, gameplay selection, completion of gameplay etc. A midtrim 112 of the machine 100 houses the pushbuttons 106.

The tactile input may optionally or further include a joystick comprising of a stick that pivots on a base and reports its angle or direction to the device it is controlling. The tactile input may optionally or further include a trackpad/touchpad being a pointing device featuring a tactile sensor to translate the motion and position of a user's fingers to a relative position on screen.

It should be appreciated that tactile input may include any suitable device that enables the player to produce an input signal that is received by the processor. Tactile input in the form of pushbuttons 106 and/or regions on touch screen 108 may include a one bet button, a max bet button, or a repeat the bet button. With a one bet button for instance, the player places a bet by pushing the one bet button. The player may increase the bet by one credit each time the player pushes the bet one button.

The midtrim 112 also houses credit input device including a bill collector 114. The credit input device may further include a coin input chute, a card and/or ticket reader, a magnetic reading head for reading a magnetic stripe card, an electronic reader for a proximity card, a near field communications reader or any other form of electronic, wireless or contact that can input credit to the gaming machine.

A credit dispenser in the form of a coin tray 116 is mounted beneath the console 102 and is provided for cash payouts from the machine 100 to the player. A hopper device (not shown) is provided which dispenses coins, or tokens equal to the amount of credit currently on the machine, into the coin tray 116. Aside from the coin tray 116, the credit dispenser may also include a ticket dispenser for issuing a ticket dispensed by a printer which the user can redeem for cash, a note dispenser, a near field communications transmitter or means to enable remote credit transfer. It should be appreciated that any suitable payout mechanisms, such as funding to the player's electronically recordable identification card or smart card, may be implemented in accordance with the gaming machine disclosed herein.

The gaming machine 100 includes a top box 118 on which artwork 120 is carried in the form of electronic visual display units. The artwork 120 could also be made from physical materials such as paper, plastic banners or posters. The artwork 120 may have generic information related to the machine or gaming system or the artwork 120 be specifically made for a particular game to be played on the machine 100. Whilst the artwork 120 is shown as being carried on the top box 118 the art work 120 can also be positioned in or on the bottom panel of the door 105, or any other part of the gaming machine 100 visible to the player.

The gaming machine 100 further includes an auditory unit in the form of speakers (not shown) to provide auditory feedback to the player of the gaming machine 100.

Referring to FIG. 2 of the drawings, game logic circuitry 200 is illustrated. The game logic circuitry 200 includes a gaming controller 201 (otherwise referred to as a logic cage) designated by the dashed lines. As will be appreciated by those skilled in the gaming industry, the logic cage 201 includes a box-like mechanical structure that has slots to guide logic cards into the proper location for electronically plugging into a backplane mounted at the rear of the cage structure. The backplane has connectors for accepting mating connectors on the logic cards. The logic cage and associated cards form one of the basic components of the gaming machine 100 and is securely housed within the cabinet of the gaming machine 100.

Central to the logic cage is a central processing unit 202 such as a processor, a microcontroller-based platform, a suitable integrated circuit, or one or more application-specific integrated circuits (ASIC's). The processor 202 is in communication with or operable to access or to exchange signals with at an outcome evaluator 203, RAM 204, ROM 206, a non-volatile memory in the form of a compact flash 230, an audio output 208 via an audio control module 209, and a random number generator 210. The audio control module 209 has its own digital signal processor, analogue to digital converters, amplifiers and other circuitry necessary to broadcast the output from the speakers. RAM 204 may include non-volatile RAM (NVRAM), magnetic RAM (MRAM), ferroelectric RAM (FeRAM), and other forms as commonly understood in the gaming industry.

Compact flash memory 230 is physically secured within a slot in the logic cage 201. In one embodiment, the compact flash memory 230 is physically secured inside the logic cage within game logic circuitry 200 by a mechanical locking mechanism. Compact flash memory 230 is partitioned 231 into two parts. A first part comprises a game software module 232 and a second part comprises a metering information module 234.

The processor 202 runs executable code residing in game software module 232 of compact flash 230 that facilitates play of the game by a player through the display device and/or push buttons and touch sensors mounted in the screen of the display. Metering information module 234 contains the gaming machine parameters which include values that would usually be stored on a hard meter. The values in metering information module 234 are only ever incremented, and cannot be reset or decremented. The only way to alter the values stored is by running the executable code stored in game software module 232, which is executed by processor 202. The executable code further interacts with the credit dispenser 116 via a payout mechanism 224 and the auditory output 208. The game software module 232 contains the rules of the game, the sequence of gameplay, communicates with external systems, monitors peripheral equipment, maintain integrity of the software code, etc. The processor 202 continually checks for error conditions.

A program which implements the game logic circuitry 200 and the user interface is further run by the central processing unit 202. The processor 202 forms part of a controller 216 that drives the screen of the video display unit 104 and that receives input signals from sensors 218. The sensors 218 include sensors associated with the push buttons and touch sensors mounted in the screen of the video display unit 104. The controller 214 also receives input pulses from mechanisms 220 and 224 to determine whether or not a player has provided sufficient credit from either payment device 114 or payment device 116 to commence playing.

In one embodiment, a player may insert an identification card into a card reader (not shown) of the gaming machine 100. Such an identification card may be a smart card having a programmed microchip, a coded magnetic strip, or coded rewritable magnetic strip, wherein the programmed microchip or magnetic strips are coded with a player's identification, credit totals (or related data), and/or other relevant information. In another embodiment, a player may carry a portable device, such as a mobile phone, a radio frequency identification tag, or any other suitable wireless device, that communicates a player's identification, credit totals (or related data), and other relevant information to the gaming device.

Figure 3:
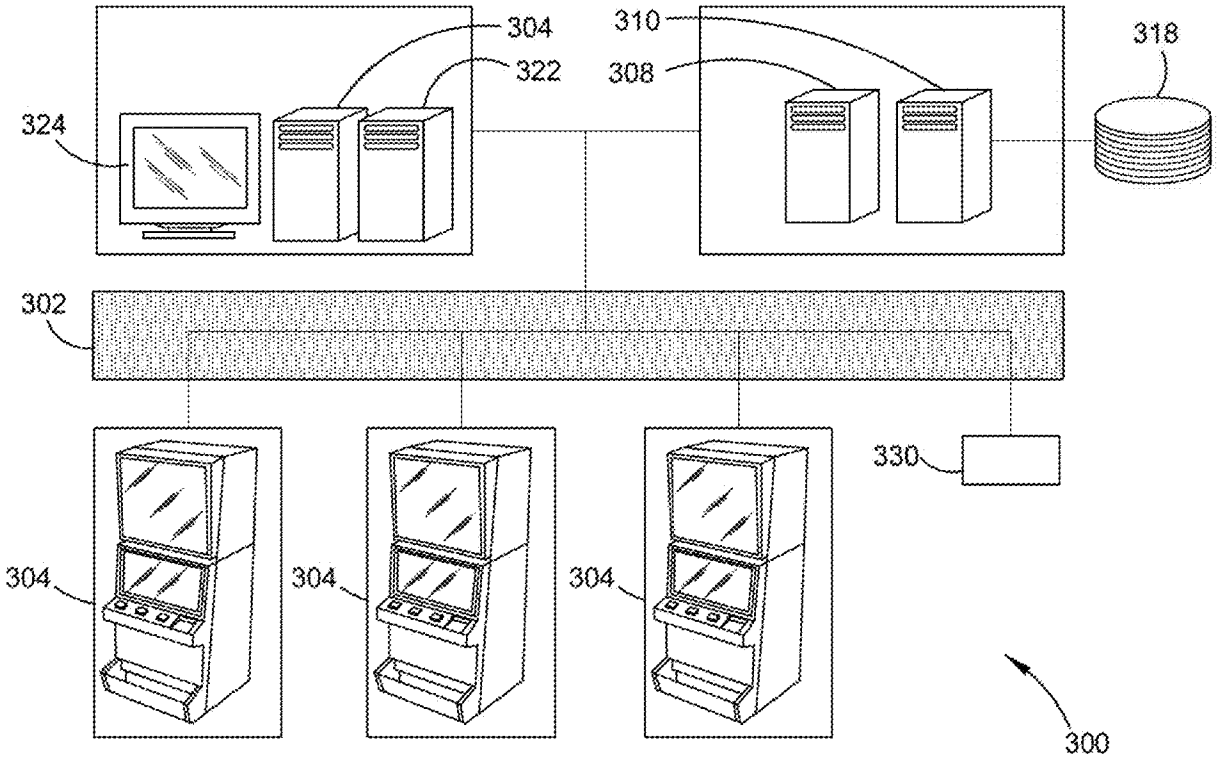
FIG. 3 shows a block diagram of functional components of a gaming system incorporating gaming machines illustrated in FIG. 1.

FIG. 3 shows a gaming system 300 in accordance with an alternative embodiment. The gaming system 300 includes a network 302, which for example may be an Ethernet network. The network 302 may also comprise a wide area network ("WAN"), the plain-old-telephone-system ("POTS), a local area network ("LAN"), a wireless LAN, the Internet, or any combination of these and other types of networks. Gaming machines 304 are connected to the network 302. The gaming machines 304 provide a player operable interface and may be the same as the gaming machines 100 shown in FIG. 1 or may have simplified functionality depending on the requirements for implementing game play.

In a thick client embodiment, game server 308 implements part of the game played by a player using a gaming machine 304 and the gaming machine 304 implements part of the game. With this embodiment, as both the game server 308 and the gaming device implement part of the game, they collectively provide a game controller. A database management server 310 may manage storage of game programs and associated data for downloading or access by the gaming devices 304 in a database 318.

In a thin client embodiment, game server 308 implements most or all of the game played by a player using a gaming machine 304 and the gaming machine 304 essentially provides only the player interface. With this embodiment, the game server 308 provides the game controller. The gaming machine will receive player instructions, pass these to the game server which will process them and return game play outcomes to the gaming machine for display. In a thin client embodiment, the gaming machines could be computer terminals, e.g. PCs running software that provides a player interface operable using standard computer input and output components.

Servers are also typically provided to assist in the administration of the gaming network 300, including for example a gaming floor management server 320, and a licensing server 322 to monitor the use of licenses relating to particular games. An administrator terminal 324 is provided to allow an administrator to run the network 302 and the devices connected to the network.

The gaming system 300 may communicate with other gaming systems, other local networks, for example a corporate network, and/or a wide area network such as the Internet, for example through a firewall 330.

Persons skilled in the art will appreciate that in accordance with known techniques, functionality at the server side of the network may be distributed over a plurality of different computers. For example, elements may be run as a single "engine" on one server or a separate server may be provided. For example, the game server 308 could run a random generator engine. Alternatively, a separate random number generator server could be provided. Further, persons skilled in the art will appreciate that a plurality of game servers could be provided to run different games or a single game server may run a plurality of different games as required by the terminals.

Figure 4:
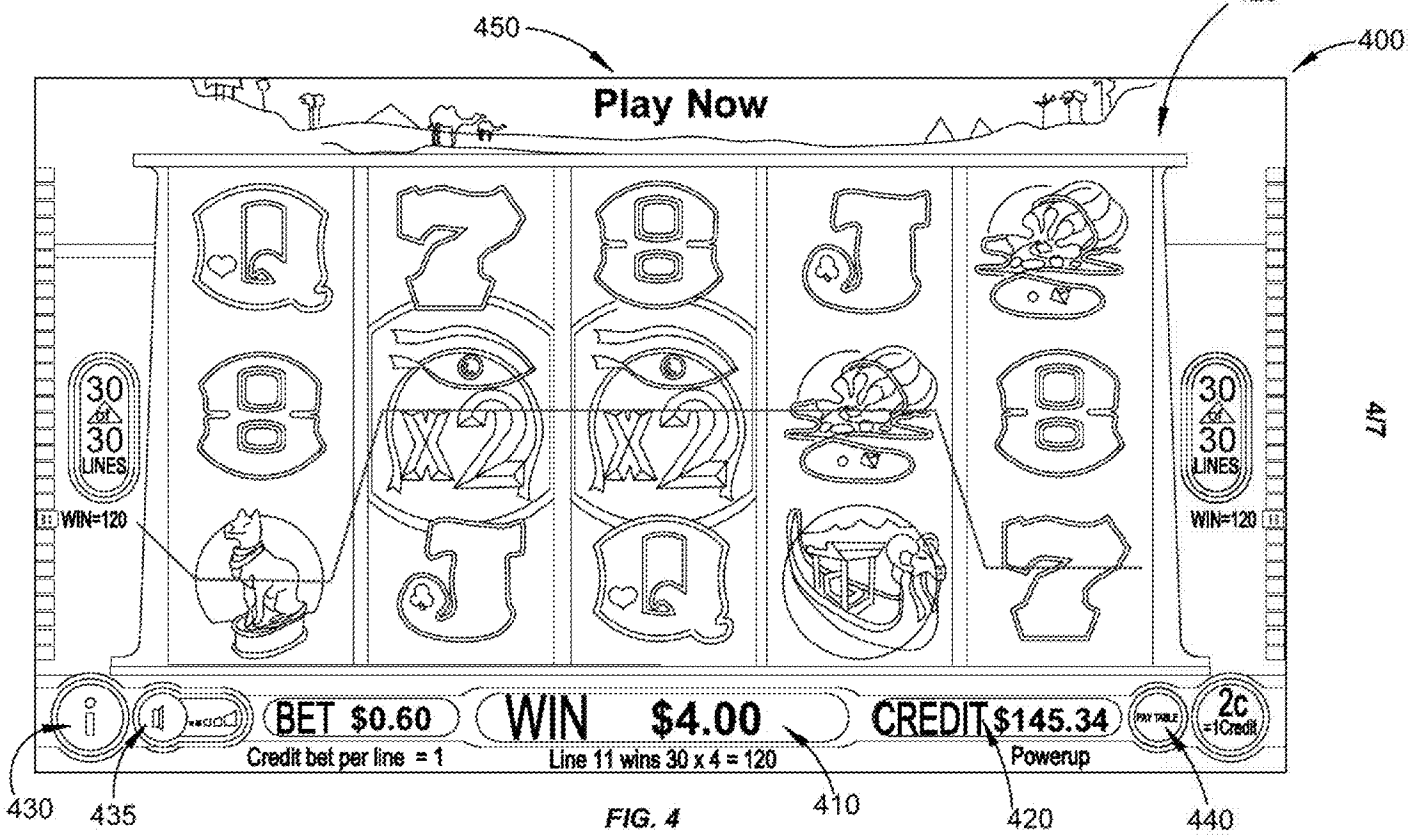
FIG. 4 shows game data displayed in a gaming window on a display device of the gaming machine.

Referring to FIG. 4, a gaming window 400 is a rectangular area on the display device 108 of the gaming machine 100 that is used to display gaming data. Gaming data of an actual game being played is displayed in the gaming window 400. A computer program is responsible for generating the gaming window 400 and for responding to user interactions with the display screen 108.

The gaming window 400 contains an area 450 across the top of the window 400 to enable the player to continue play of the game. As is shown, at the relevant point in time, line 30 of 30 has yielded a win of $4.00 (410) and the player has a credit of $145.34 (420).

Along the bottom of the gaming window 400 are a number of features available to the player. For instance the player is able to access information 430 about the particular game being played, change the volume 435 of the game, review information in the pay-table 440 and continue play 450 of the game if subsequent plays are available.

To trigger a replay event an operator touches a soft key provided on the gaming window. A program run by the game controller's processor 202 handles the details of resizing the window 400, and the game program running under control of the gaming controller 200 responds to the function of resizing the window 400. The processor 202 "knows" when the gaming window is resized because a message is passed to it indicating that the resizing operation is complete, and the game program responds by repositioning the text/images within the resized window. Gaming window resizing is code driven by the controller and stored to RAM 204.

Figure 5:
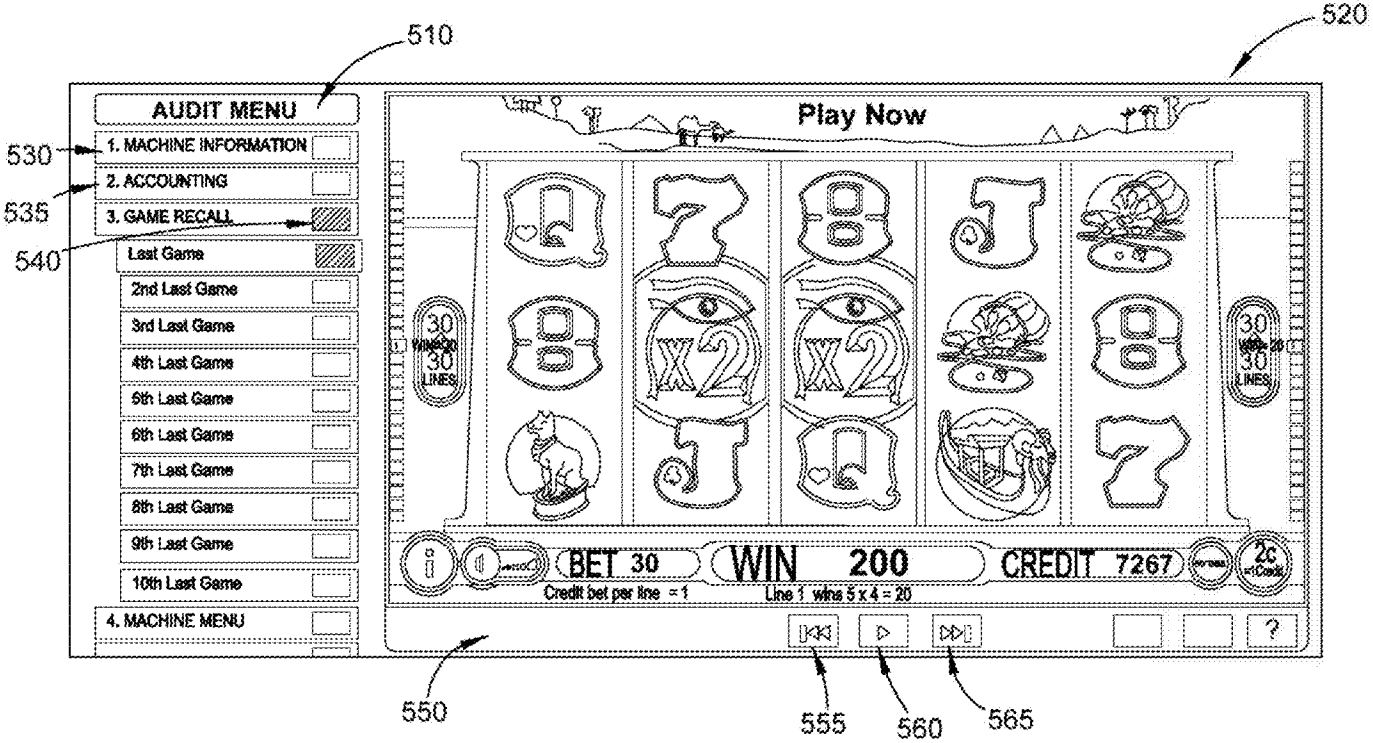
FIG. 5 shows a first navigation window and replayed game data which is displayed in a resized gaming window on a display device of the gaming machine illustrated in FIG. 1.

FIG. 5 shows a navigation window 510 and replayed game data which is displayed in a resized gaming window 520 on the display device of the gaming machine. Together navigation menu 510 and the resized gaming window 520 are referred to as the audit screen. The navigation window 510 enables the operator to access machine information 530, accounting information 535 and select the last ten played games by touching the drop down menu 540. As illustrated the resized gaming window 520 is positioned to the right of the audit menu. However a player/operator is able to resize and drag the gaming window 520 anywhere on the display device.

The gaming window 520 has a control panel 550 with soft key touch screen buttons that include rewind control 555, play control 560 and fast forward control 565. These controls enable the operator to simplify the replay mode. When play of a game is being replayed in the resized gaming window 520 the operator can accordingly fast forward and rewind through the game at his or her leisure. Soft key touch button 570 enables a player/operator to see detailed replay game meters for the particular game that has been recalled.

Figure 6:
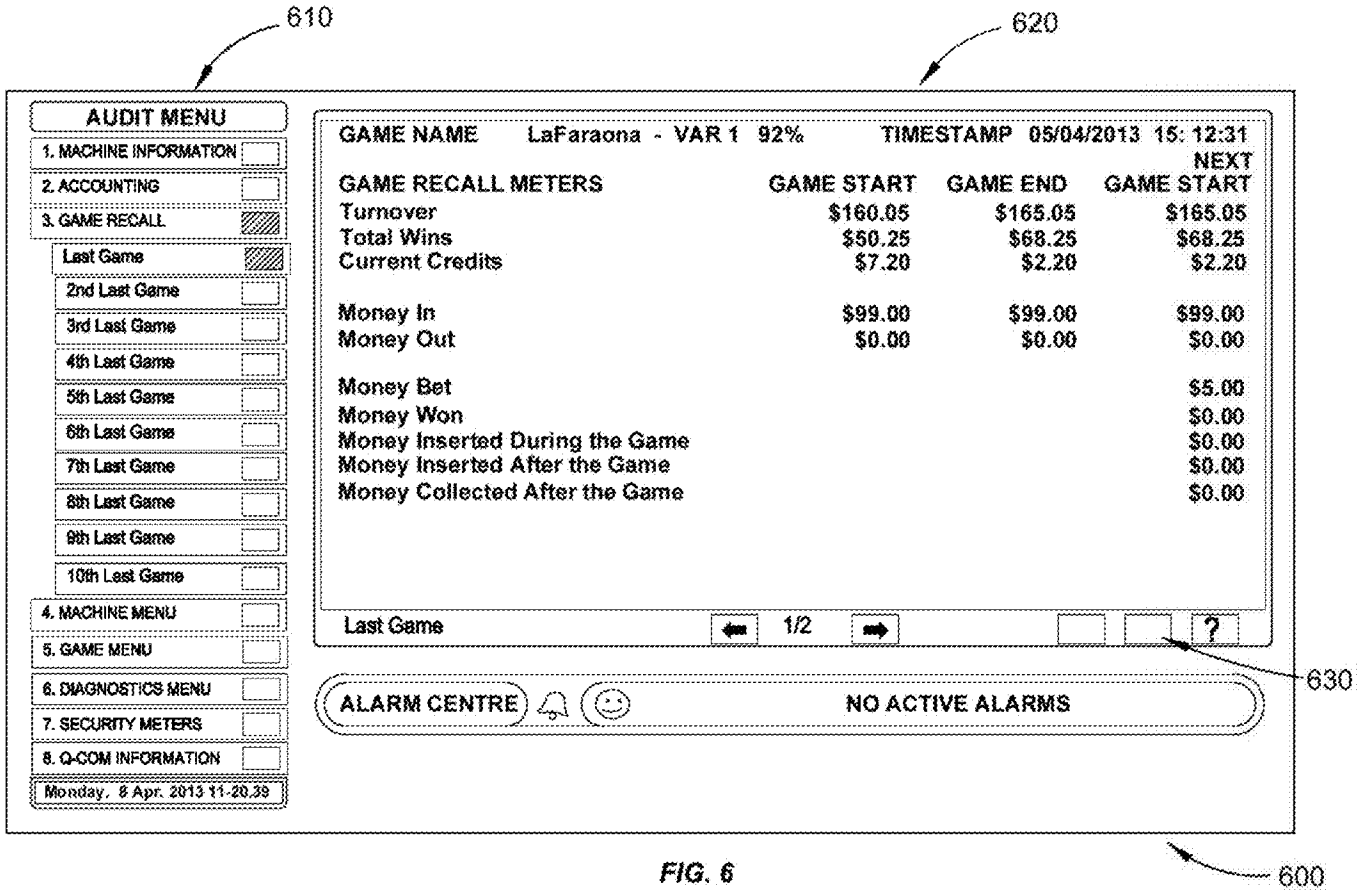
FIG. 6 shows a second navigation window and replayed game meter data which is associated with the replayed game playing in resized gaming window of FIG. 5.

FIG. 6 illustrates a further audit mode screen 600 which is displayed after a player/operator activates the soft key touch button 570 in FIG. 5. As with FIG. 5, audit mode screen 600 has a navigation window 610 which is the same as the navigation window 510 and game meter data 620 which is associated with the replayed game in resized gaming window 520 of FIG. 5. When the player/operator wishes to revert to the replayed game, soft key 630 is activated.

Figure 7:
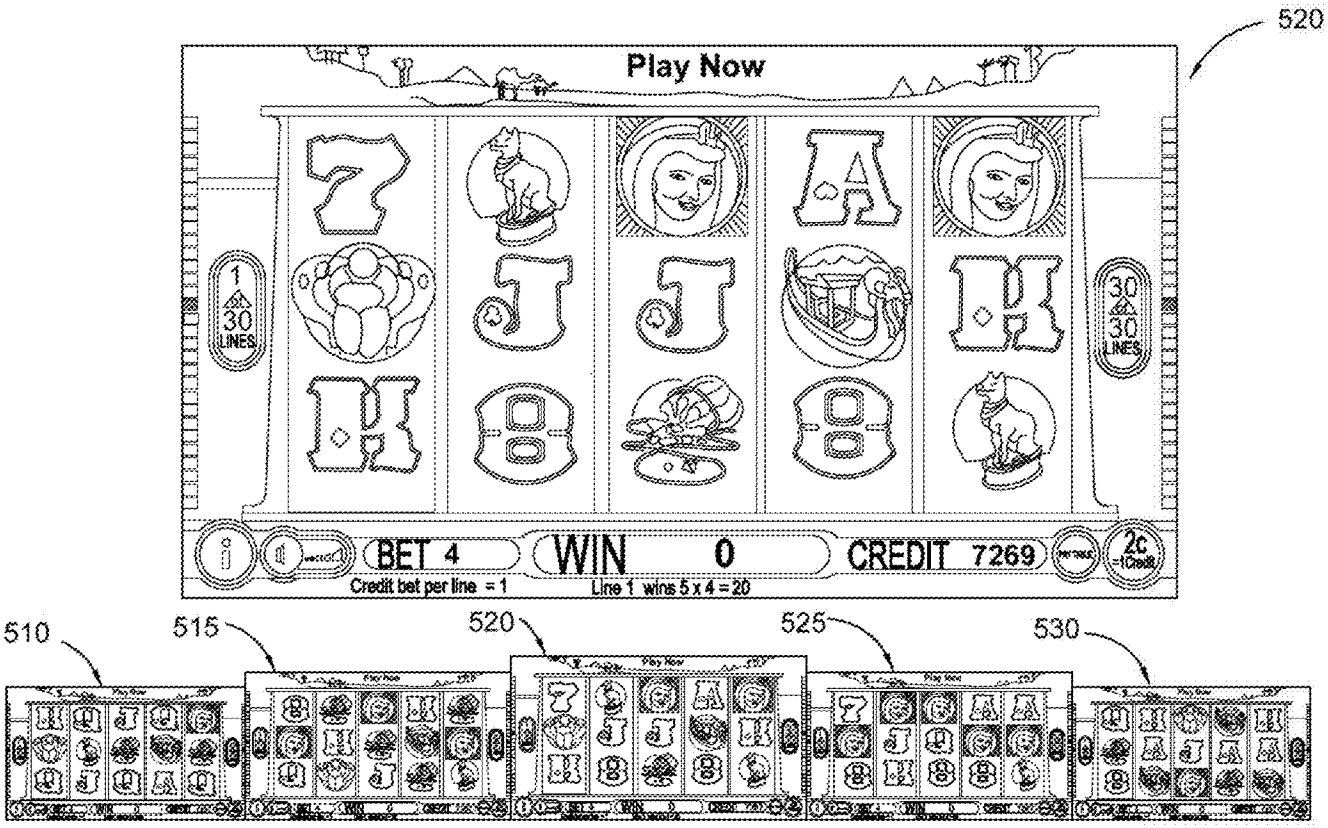
FIG. 7 shows an alternative embodiment of a navigation window.

FIG. 7 shows an alternative arrangement to effect game recall. In this arrangement, rather than a drop down menu 540 as is illustrated in FIG. 5, thumbnail images (710, 715, 720, 725 and 730) of each of the last played games (only five of which are illustrated in FIG. 7) are displayed. Each thumbnail image (710, 715, 720, 725 and 730) represent smaller copies of the original played games and the thumbnail images are presented in a window frame area at the bottom of the display screen. The image is a static image of perhaps the start of a previously played game, however selection of an image will replay that entire game. The operator is then able to finger swipe through previously played games and select any one of the thumbnails. In FIG. 7, thumbnail 720 in FIG. 7 has been selected for larger viewing.

An advantage of at least one embodiment of the invention is that the occurrence of a player confusing a replay game as being a live game for which money is being placed, is likely to be reduced.

It will be appreciated by persons skilled in the art that numerous variations and/or modifications may be made to the above-described embodiments, without departing from the broad general scope of the present disclosure. The present embodiments are, therefore, to be considered in all respects as illustrative and not restrictive.

While the foregoing description has been provided by way of example of the preferred embodiments of the present invention as presently contemplated, which utilise gaming machines of the type found in casinos, those skilled in the relevant arts will appreciate that embodiments of the present invention also may have application to internet gaming and/or have application to gaming over a telecommunications network, where mobile handsets are used to display game outcomes and receive player inputs. Such mobile devices include smart phones, notebooks, tablets, iPads and laptop computers. For instance free mobile device games may be offered for download and play on a players personal mobile device as a bonus game play. In such an embodiment the gaming machine may comprise a power interface to enable interaction between the respective devices and/or a communication or wireless interface to enable data transfer. During game play, the gaming machine may be configured to send information to the player's personal mobile device.

Further embodiments may enable a player to upload the outcome of a game or bonus game to a social media site(s), post tournament scores etc.

Certain steps in the processes or process flows described in this disclosure naturally precede others for the invention to function as described. However, the invention is not limited to the order of the steps described if such order or sequence does not alter the functionality of the invention. That is, it is recognized that some steps may performed before, after, or parallel (substantially simultaneously with) other steps without departing from the scope and spirit of the invention. In some instances, certain steps may be omitted or not performed without departing from the invention. Further, words such as "thereafter", "then", "next", etc. are not intended to limit the order of the steps. These words are simply used to guide the reader through the description of the exemplary method.

Additionally, one of ordinary skill in programming is able to write computer code or identify appropriate hardware and/or circuits to implement the disclosed invention without difficulty based on the flow charts and associated description in this specification, for example.

Therefore, disclosure of a particular set of program code instructions or detailed hardware devices is not considered necessary for an adequate understanding of how to make and use the invention. The inventive functionality of the claimed computer implemented processes is explained in more detail in the above description and in conjunction with the figures which may illustrate various process flows.

In one or more exemplary aspects, the functions described may be implemented in hardware, software, firmware, or any combination thereof. If implemented in software, the functions may be stored on or transmitted as one or more instructions or code on a computer-readable medium. Computer-readable media include both computer storage media and communication media including any medium that facilitates transfer of a computer program from one place to another.

A storage media may be any available media that may be accessed by a computer. By way of example, and not limitation, such computer-readable media may comprise RAM, ROM, EEPROM, CD-ROM or other optical disk storage, magnetic disk storage or other magnetic storage devices, or any other medium that may be used to carry or store desired program code in the form of instructions or data structures and that may be accessed by a computer.

Also, any connection is properly termed a computer-readable medium. For example, if the software is transmitted from a website, server, or other remote source using a coaxial cable, fiber optic cable, twisted pair, digital subscriber line ("DSL"), or wireless technologies such as infrared, radio, and microwave, then the coaxial cable, fiber optic cable, twisted pair, DSL, or wireless technologies such as infrared, radio, and microwave are included in the definition of medium.

Disk and disc, as used herein, includes compact disc ("CD"), laser disc, optical disc, digital versatile disc ("DVD"), floppy disk and blu-ray disc where disks usually reproduce data magnetically, while discs reproduce data optically with lasers. Combinations of the above should also be included within the scope of computer-readable media.

Although selected aspects have been illustrated and described in detail, it will be understood that various substitutions and alterations may be made therein without departing from the spirit and scope of the present invention.

The claims defining the invention are as follows:

1. A gaming machine is provided comprising:

a display device;

an input device;

a credit input device; and a controller comprising a processor and a memory device, the memory device storing a plurality of instructions which when executed by the processor in response to receiving input via the credit input device, cause the processor to operate with the display device and the input device to:

(i) for each of a plurality of plays of a game, display game data in the gaming window on the display device, the gaming window having sides defining a geometrical shape and defining an enclosed area for presenting said game data on the display device; and (ii) upon a replay triggering event, resize the geometric shape of the gaming window and replay at least one of said plurality of plays of the game in the resized gaming window, wherein the game data displayed in the resized gaming window is accordingly scaled;

wherein the processor is operable with the display device and the input device to display a border associated with at least one side of the gaming window when the gaming window is in a replay format;

wherein the border comprises one or more controls displayed on the display device to enable a player/operator to do any one of pause, fast forward and rewind through one or more plays of a game.

2. A gaming machine according to claim 1, wherein the at least one replayed play of the game comprises the last played game.

3. A gaming machine according to claim 1, wherein in the event that a plurality of plays of a game are replayed, the number of replayed plays of the game is based on at least one of the wagers placed by a player.

4. A gaming machine according to claim 1, wherein resizing the geometric shape of the gaming window comprises shrinking respective sides of the gaming window.

5. A gaming machine according to claim 4, wherein each side of the gaming window is proportionally shrunk.

6. A gaming machine according to claim 1, wherein the processor is further operable with the display device and the input device to control processes for defining the size and shape of a replay control window.

7. A gaming machine according to claim 6, wherein the replay control window is configured to provide a player/operator access to one or more of each of the plurality of plays of a game, machine information, accounting information and game play statistics.

8. A gaming machine according to claim 1, wherein display device is a touch screen display.

9. A gaming machine according to claim 1, wherein the replay triggering event is activated via the input device, with the input device being a soft key.

10. A gaming machine according to claim 9, wherein the replay triggering event comprises a thumbnail image.

11. A gaming machine according to claim 9, wherein the memory device is operable to cause the processor to further operate with the display device and the input device to present on the display device a plurality of thumbnail images.

12. A gaming machine according to claim 11, wherein the controller is configured such that swiping of each thumbnail images rotates the respective games played from left to right of the screen and from right to left of the screen to show other replayed games.

13. A gaming machine according to claim 11, wherein selection of a thumbnail image causes the controller to replay the entire game.

14. A gaming machine according to claim 11, further comprising an audio module and an audio output device such that when a thumbnail picture is selected the controller, via the audio module generates a sound for output at the audio output device.

* * * * *